United States Patent [19]

Moreno

[11] 4,236,713

[45] Dec. 2, 1980

[54] FROG GAME

[76] Inventor: Joseph A. Moreno, P.O. Box 568, Saegertown, Pa. 16433

[21] Appl. No.: 14,972

[22] Filed: Feb. 26, 1979

[51] Int. Cl.[3] ..... A63F 9/14

[52] U.S. Cl. ..... 273/1 M

[58] Field of Search ..... 273/1 M

[56] References Cited

U.S. PATENT DOCUMENTS

| | | | |
|---|---|---|---|
| 1,858,020 | 5/1932 | Linke | 273/1 M UX |
| 2,747,872 | 5/1956 | Harvey | 273/1 M |
| 2,956,807 | 10/1960 | Luchsinger | 273/1 M |
| 3,114,547 | 12/1963 | Joslyn | 273/1 M |
| 3,214,171 | 10/1965 | Luchsinger | 273/1 M X |
| 3,657,457 | 4/1972 | Poynter | 273/1 M X |
| 3,758,693 | 9/1973 | Ebert | 273/1 M X |

FOREIGN PATENT DOCUMENTS

| | | | |
|---|---|---|---|
| 1282155 | 12/1961 | France | 273/1 M |
| 251359 | 5/1926 | United Kingdom | 273/1 M |

*Primary Examiner*—Paul E. Shapiro

*Attorney, Agent, or Firm*—Charles L. Lovercheck

[57] ABSTRACT

A game board having a path with obstructions and a first playing piece to be pushed along the path by magnetic repulsion from a magnet in a hand held member and a second permanent magnet in a second playing piece. The board has a path from which the pieces are to be pushed and various obstructions along the path.

1 Claim, 5 Drawing Figures

FROG GAME

GENERAL DESCRIPTION OF THE INVENTION

It is the purpose of the present invention to provide an interesting and entertaining game wherein a board is provided with a path and various obstacles in the form of rivers, animals, persons, bridges, trees, hedges, rocks, dragons and goblins. The playing piece is in the form of a frog having a permanent magnet in it and the player's hand holds the snake by the tail. The snake has a permanent magnet in its head which urges the frog along the path by magnetic repulsion.

OBJECTS OF THE INVENTION

It is an object of the invention to provide an improved game.

Another object of the invention is to provide a game that is simple in construction, economical to manufacture and simple and efficient to play.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
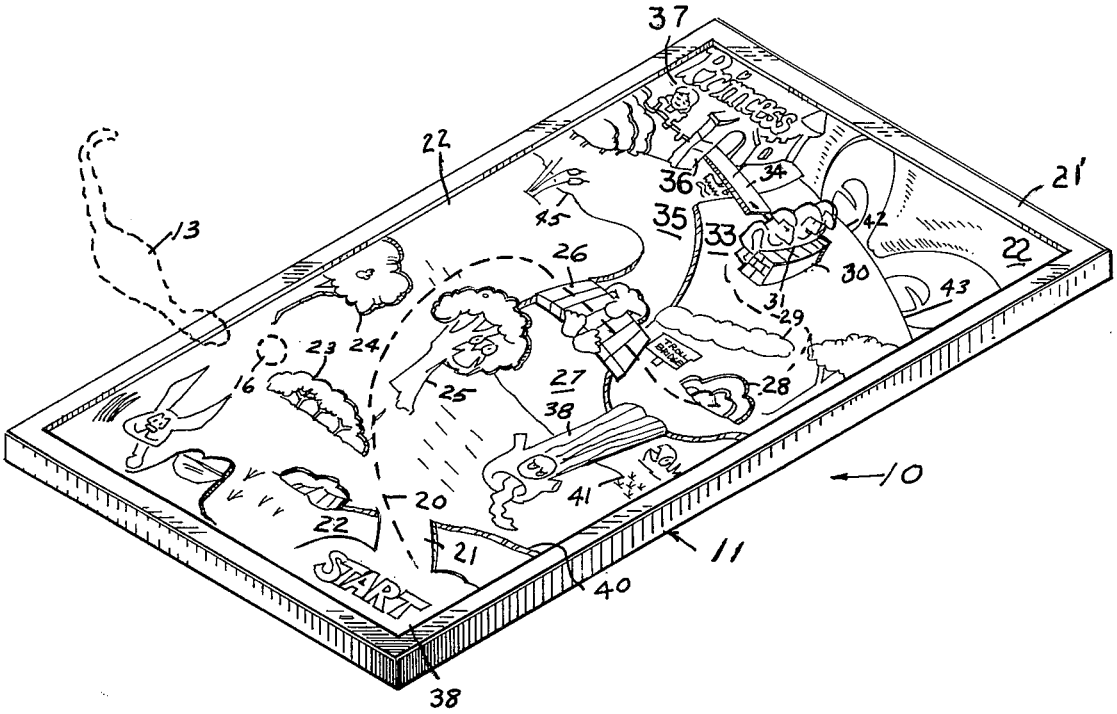
FIG. 1 is an isometric view of the game according to the invention.
Figure 2:
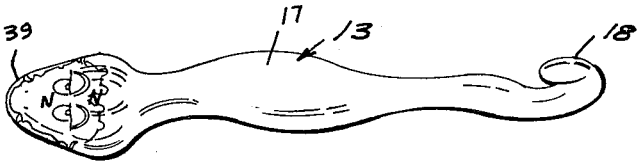
FIG. 2 is a top view of the second playing piece which is in the form of a snake with a tail that forms a handle.
Figure 3:
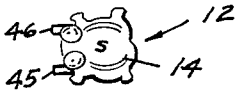
FIG. 3 is a top view of another playing piece in the form of a frog.
Figure 4:
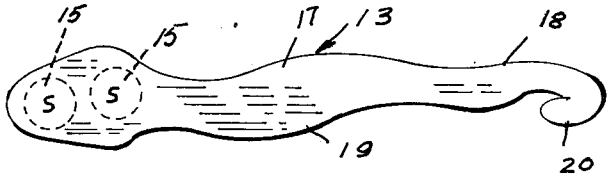
FIG. 4 is a bottom view of the snake shown in FIG. 2.
Figure 5:
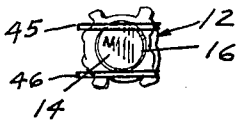
FIG. 5 is a bottom view of the frog shown in FIG. 3.
Figure 5:
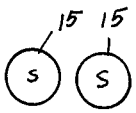

Now, with more particular reference to the drawings, the game is indicated generally at 10 made up of a game board 11, and game pieces 12 and 13. Playing piece 12 is in the shape of a frog with a flat bottom and having runners fixed to its bottom and parallel to the bottom and having a round magnet 14 inserted in it. The runners 45 and 46 project out in front and hold the frog from tipping forward. The second playing piece 13 is in the form of a snake having a permanent magnet 15 installed in its flat bottomed head. Permanent magnets 15 are similar to the magnets 14, but there may be two of them with their flat sides downward. They are polarized from top to bottom opposite from the magnet in the frog so that like poles in the snake are the same to like poles in the head of the frog. The permanent magnets are relatively thin and in the form of discs. The snake's body may be round in cross-section and have the general appearance of an actual snake. The snake has a body 17 and tail 18 that has a curled tip 20 thereon and is attached to the body 17 and forms a convenient hand grip.

The board has a rim 21' around the outer edge which extends up slightly and is covered by a transparent cover 22. The board has a path 20 that extends across the bridge 21 and over the river 22 and past the shrubbery 23, trees 24 and 25 with owl in it, across the bridge 26 which extends over the water 27 past the frog eating rock and end of log 38 with a dragon in it, and through the hedge 29, around the walls 30 which has the palace guards 31 behind them and along the path 33, over the bridge 34 which crosses the water 35 and under the arch 36 to the princess' palace 37.

The operator can place the frog on the starting position 38 flat bottom down and place the head of the snake 39 adjacent to the rearend of the frog. If the snake is not properly maneuvered to get the polarity adjacent like pole in the frog magnet, the frog will recess. The polarity of the magnets are such that the frog will be forced by the snake and if the snake is skillfully maneuvered, the frog will move along the path 20, however, the operator must be careful or he will push the frog out of the path and when crossing obstacles such as bridges 20, 26 and 34 or passing between trees 24 and 25, the frog may fall off the bridge or run into the trees. The snake can be moved along the transparent cover if desired or slid over the surface of the path.

The game board is three dimensional and water in 22, 27 and 35 recessed below the level of the bridges 20, 26 and 27. The trees also may be raised approximately one eighth of an inch above the level of the path giving an interesting arrangement.

Since the hazards below the bridges 20, 26 and 34 are below the level of the path, when a frog falls off a bridge he cannot be recovered unless he is pushed up one of the re-entry ramps 40, 41, 42, 43 or 44. These ramps are inclined from the path level to the water level providing a ramp surface for the frog to slide on.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A game board and character combination comprising, a generally rectangular board having obstacles thereon, a first playing piece in the form of a frog and a second playing piece in the form of a snake, a path extending around said board at simulated ground level, said frog having a flat lower surface with parallel runners on the bottom, a first magnet embedded in said frog, said first magnet having a first polarity at the top and a second polarity at the bottom, said first polarity adapted to slide over said board, said magnets being in the form of circular discs, the polarity of the top of said first magnet and the polarity of the top of said second magnet being alike, whereby the field of said first magnet repels the field of said second magnet, said snake having a curl in its tail adapted to be grasped by a hand, and a body, and a second magnet embedded in the head of said snake adjacent its nose, said board having a top surface having said path therein, said body and tail being integral with each other, obstacles in the form of bridges at said ground level and logs on said board extending above said path, said first piece being adapted to rest on said path and said second piece being adapted to move adjacent to said first piece whereby said second magnet repels from first magnet and forces the said frog to move over said board surface along said path, said permanent magnets being so oriented that the like poles in the snake will repel the like poles in the frog, said board having a transparent cover disposed in a plane spaced above said path, and adapted to have said snake be moved thereover.

* * * * *